United States Patent [19]

Sherwood

[11] Patent Number: 4,955,430

[45] Date of Patent: Sep. 11, 1990

[54] CONTINUOUS LEAD-FLOAT CASTING OF STEEL

[76] Inventor: William L. Sherwood, 7249 Cypress Street, Vancouver B.C., Canada, V6P 5M2

[21] Appl. No.: 309,124

[22] Filed: Feb. 13, 1989

Related U.S. Application Data

[63] Continuation of Ser. No. 21,749, Mar. 4, 1987, abandoned.

[30] Foreign Application Priority Data

Sep. 29, 1986 [CA] Canada ..... 519252

[51] Int. Cl.[5] ..... B22D 11/124

[52] U.S. Cl. ..... 164/485; 164/81; 164/440; 164/443; 164/490

[58] Field of Search ..... 164/440, 490, 443, 444, 164/485, 486, 81

[56] References Cited

U.S. PATENT DOCUMENTS

| | | | |
|---|---|---|---|
| 2,789,327 | 4/1957 | Corley | 164/440 |
| 3,658,117 | 4/1972 | Fromson | 164/486 |
| 4,625,788 | 12/1986 | Buxmann et al. | 164/431 |

FOREIGN PATENT DOCUMENTS

| | | | |
|---|---|---|---|
| 61147947 | 7/1976 | Japan | 164/440 |

*Primary Examiner*—Kuang Y. Lin

[57] ABSTRACT

The invention discloses a method and apparatus for horizontal continuous casting of thin steel slabs by floating liquid steel on the surface of a pool of molten lead and allowing the steel to solidify by cooling to form a continuous flat ribbon. The virtually complete immiscibility between iron and lead is the key to the invention and also the fact that iron floats on lead, both are good heat conductors and molten lead is non-wetting towards solid iron and a good lubricant for it. The method is conducted in an elongated tray containing a molten lead pool and incorporating lateral edge dams defining the cast slab width. Liquid steel from a prior process is continually introduced from a tundish or ladle and distributed uniformly across the entry end while avoiding turbulence and mechanical mixing between lead and steel. Heat is extracted by external cooling as the steel progresses along the tray, causing it to freeze and form an outer shell solidification front extending transversely between the edge dams. This shell progressively thickens as the solidifying slab is pulled towards the pool exit end by withdrawal pinch rolls. The tray is enclosed and force-cooled during casting and the liquid metal surfaces are protected against oxidation by a non-oxidizing gas introduced into the enclosure. External heating of the tray is also provided to maintain the lead molten in preparation for continuous casting. Adjustable edge-guide rollers maintain lateral alignment of the solidifying steel slab, which can be cut to length following exit from the withdrawal rollers or, for example, be passed directly into a flat-rolling mill followed by a cooling table and coilers.

25 Claims, 5 Drawing Sheets

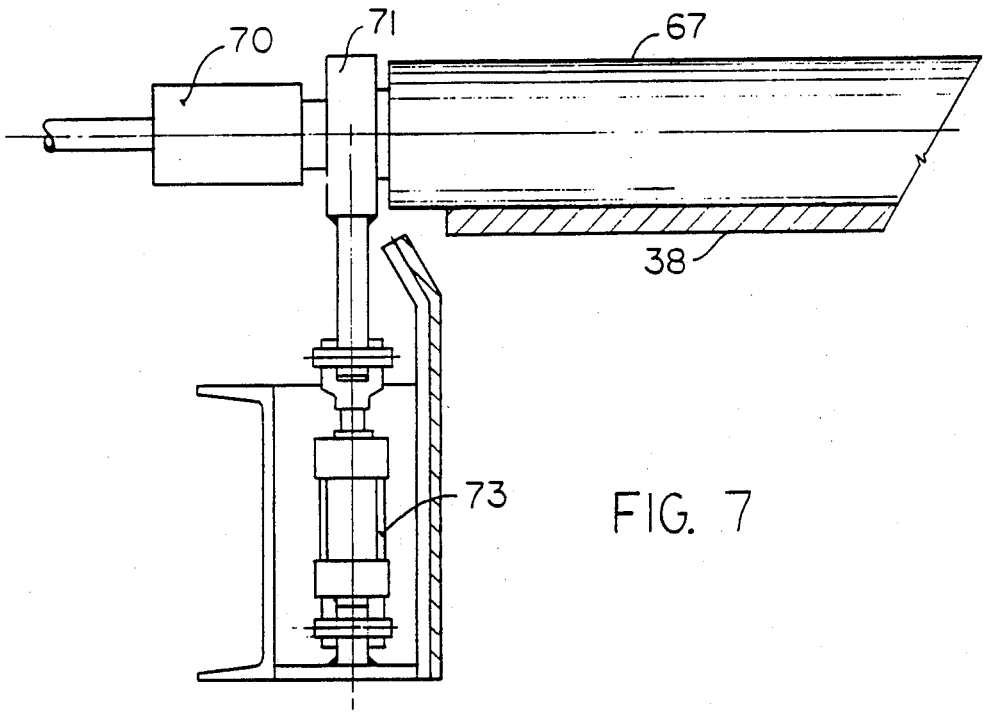
FIG. 7
FIG. 9
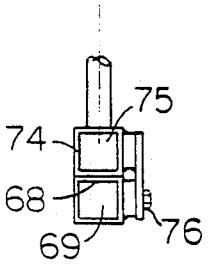
FIG. 8
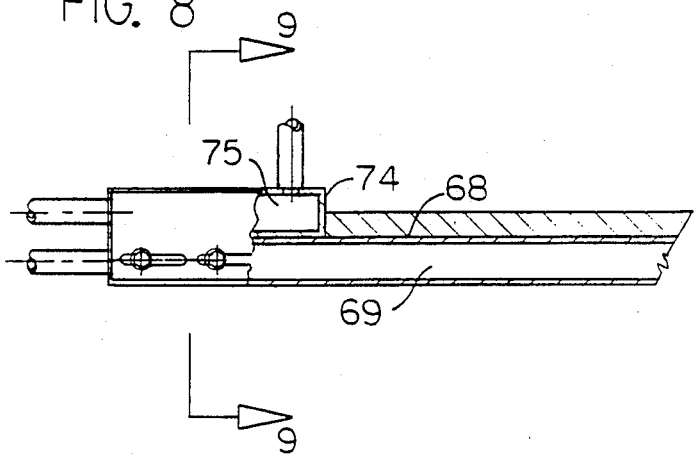
FIG. 11
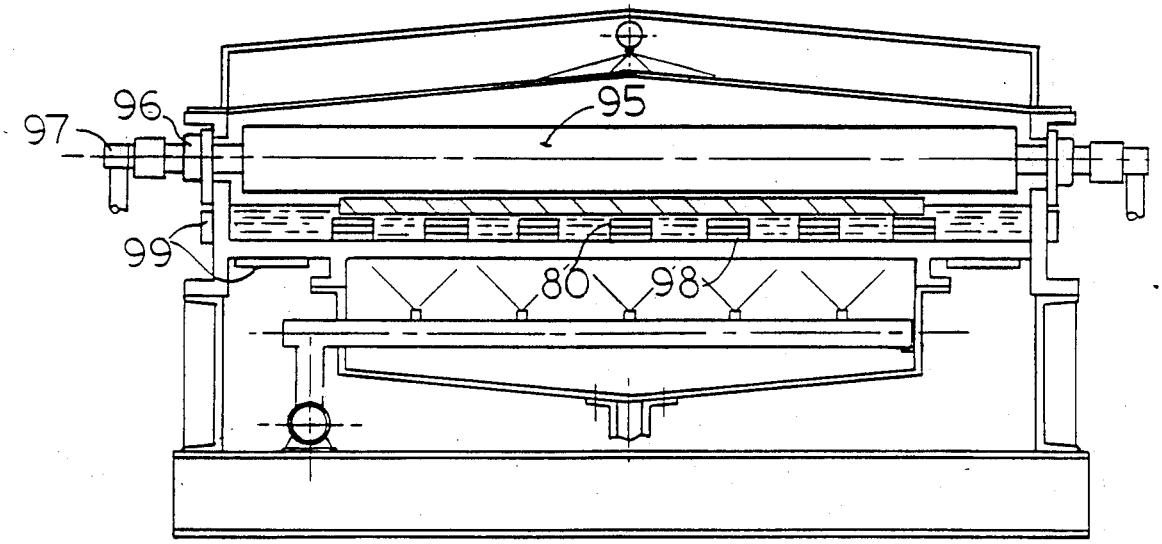

CONTINUOUS LEAD-FLOAT CASTING OF STEEL

This application is a continuation of my co-pending application, Ser. No. 07/021,749, filed Mar. 4, 1987, now abandoned.

The invention relates to the continuous casting of steel and, more particularly, to a horizontal lead-float method and apparatus adapted for continuous casting of thin steel slabs.

Present continuous steel casting methods generally involve some form of water-cooled metal mold enclosure for freezing an outer shell of the continuously cast section, following which solidification is carried to completion by passing the section through an apron incorporating water sprays impinging directly on the surface of the casting. The present conventional vertical and curved-mold continuous casting machines for steel slabs entail high capital investment and are most suited to casting of thick sections. Two principal problems contributing to complexity are requirements for large overall machine height, and the need for an extensive, strong and precise withdrawal roll assembly to combat the internal ferrostatic pressure within the partly solidified section and prevent surface bulging and molten steel breakouts.

A large proportion of the thick slabs are subsequently reduced by hot rolling to less than 3 mm. thick as sheet or coiled strip. The amount of rolling mill reduction tends to be excessive and a lot of work and cost potentially can be saved by casting within the range of 3–50 mm. thick, rather than 100 mm. and thicker, as with the current conventional technology. '

Important objects of the method and apparatus of this invention are to provide the following:

(a) a continuous steel casting method and casting machine adapted for casting thin flat, wide sections;
(b) a horizontal casting method providing for horizontal discharge of the cast product along with low casting machine headroom;
(c) a low capital investment cost for the casting equipment, buildings and auxiliaries required for the caster;
(d) good internal and surface quality of the cast product;
(e) simple and staightforward feeding and control of the casting operation;
(f) facility for combining the casting operation with subsequent direct rolling without intermediate cooling and reheating of the cast sections; and
(g) elimination of mold friction and its associated operating and surface quality problems and limitations.

There is a unique relationship of properties between iron and lead. Liquid iron and lead are immiscible and coexist as liquids right up to steelmaking temperatures. Iron is lighter than lead and floats on it. Liquid lead is non-wetting towards solid iron and is a good lubricant for it. Both liquid and solid lead are good heat conductors. Miscibility is also very limited between molten lead and some of the principal alloying contituents of steel, notably chromium and nickel.

This invention stems from recognition of the applicability of this combination of complementary properties to the horizontal casting of steel. The glass industry provides another notable instance of such an application of particular material properties, whereby most flat plate glass is made by the continuous float process, involving the floating of molten or semi-molten glass on molten tin. It will be evident that the casting method of the invention applies only to iron and steel and their alloys, and is not applicable to other metals.

The invention provides for maintaining a molten lead pool in a lead holding tray and introducing a layer of liquid steel onto the lead surface at the entry end extending across and confined between two edge dams defining the width of the steel slab being cast. The liquid steel cools and progressively solidifies by freezing as the steel progresses towards the exit end of the pool by heat transfer away from the underside into the molten lead and by radiation and convection away from the exposed surface of the floating steel. The solidified steel is continually being withdrawn by means of rollers or other means from the exit end of the pool as the entry end is likewise being replenished with liquid steel at the entry end. The edges of the moving slab are appropriately guided laterally, for maintaining adequate centering along the pool.

The invention also provides for the step of distributing the liquid steel across the width of the entry end evenly in a controlled pattern, at low velocity avoiding impingement and turbulence, in order to avoid mechanical mixing interaction between the molten lead and liquid steel during entry. A preferred embodiment involves maintaining an elongated feed reservoir of molten steel spanning transversely across the entry end from edge-dam to edge-dam, and allowing liquid steel to flow through a row of orifice openings in a baffle separating the reservoir from the liquid steel floating on the molten lead, at an elevation approximating the upper surface level of the steel. This reservoir is normally confined in a transverse launder connecting with the lead-holding tray and is fed from a continuous casting tundish, ladle or equivalent source of steel having a controlled composition and temperature. The steel flow from the tundish may be throttled to control the casting rate, and shrouded to protect the steel stream from the atmosphere. The launder may also be covered and the unfilled portion shrouded by an inert purging gas.

Another preferred embodiment incorporates an inverted weir separating infeed from outfeed sides of the feed reservoir, further damping turbulence during feeding. Steel entry then takes place by gravity flow over the crest of a dam separating the outfeed side of the reservoir from the molten-lead pool, or alternatively, via a perforated baffle as above. The dam crest may also be notched as an additional measure to secure a controlled feed distribution across the entry end between edge-dams.

The invention also provides external cooling of the lead-holding tray bottom to maintain an adequate and consistent rate of heat removal. The top of the tray is also preferably covered by an externally cooled enclosure. In the preferred embodiment, the rate of external cooling is separately adjustable at various intervals during the steel progression from entry towards exit, at least between the liquid steel feed-settling area at the entry end, the liquid-solid solidification-front area (analogous to a mold-section) and the partially-solid slab cooling and solidification area approaching slab exit (analogous to a spray chamber). The tray top enclosure is also adapted for maintaining atmosphere-control in contact with the exposed molten lead pool and steel slab surfaces employing an inert or non-oxidizing gas from an external source.

The invention includes provision for an area of accelerated cooling in a concentrated area spanning the steel slab width at the onset of steel freezing, in order to achieve a cohesive shell across the initial solidification front and thereby allow an increase in the rate of steel throughput. This is accomplished by a very shallow molten lead pool to minimize heat flow resistance, as well as by more intense external cooling in the region of the solidification front.

The only significant frictional resistance to cast slab movement during casting is provided by the edge dams at the time of slab-edge freezing and, therefore, the lighter the section the less resistance, and the wider the slab, the lesser the relative overall influence of this friction. Otherwise, there is not any characteristic limitation of the method and apparatus as to slab thickness.

It will be understood that the background, objects and general summary of the invention for continuous lead float casting of steel has been generally described and that various other objects, features and advantages of the method and apparatus of this invention will become apparent from the following detailed description and claims and by referring to the accompanying drawings, in which:

FIG. 7 is a partial end elevation view along plane 7—7 of FIG. 3 of a preferred hold-down roller arrangement;

FIG. 8 is an end elevation view of the slab seal-bar assembly;

FIG. 9 is a section along plane 9—9 of FIG. 8;

FIG. 11 is an end elevation view partially in section, along plane 11—11 of FIG. 5.

Figure 1:
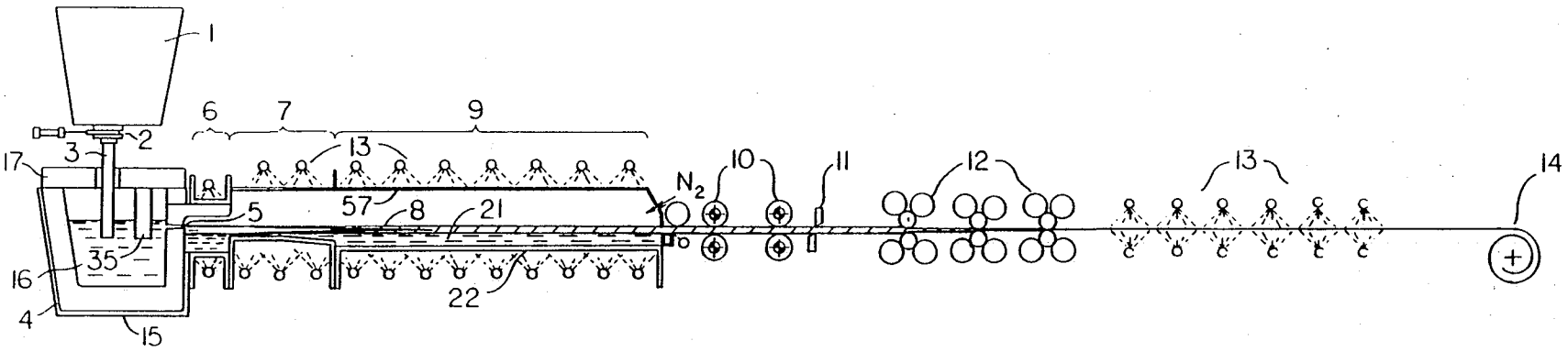
FIG. 1 is a diagrammatic side elevation illustrating the method and apparatus of this invention as applied to the direct production of hot-rolled strip in coil form.

Referring to FIG. 1, the steel is poured from a continuous casting tundish or ladle 1, for example, by way of a throttling slide gate 2 and shroud 3 into the feed reservoir of liquid steel 16 contained within width distributor launder 4. The liquid steel passes from the reservoir by gravity by way of a width distributor dam or perforated baffle into feed settling area 6 to float on the surface of molten lead pool 21 contained within a holding tray 22. A solidified surface shell is formed on the steel in rapidly-cooled liquid-solid solidification front area 7 (or mold section') and the solidification carried further to completion in the partially-solid slab cooling and solidification area 9, as the steel passes from entry to exit end of pool 21 by the action of the withdrawal pinch rolls 10. The pool 21 is enclosed by a force-cooled top cover enclosure 57 within which a non-oxidizing atmosphere is maintained, and the bottom of holding tray 22 is also force-cooled. The slab exit issealed and the slab level is guided by alignment of the horizontal pinch rolls 10 and laterally by edge-guide rolls. The hot solidified slab is passed directly on for hot reduction by rolling mill rolls 12 to the desired hot-rolled thickness, followed by a spray cooling table 13 and production of coils in coilers 14. A shear or torch-cut assembly 11 is provided for separation between coils.

Figure 3:
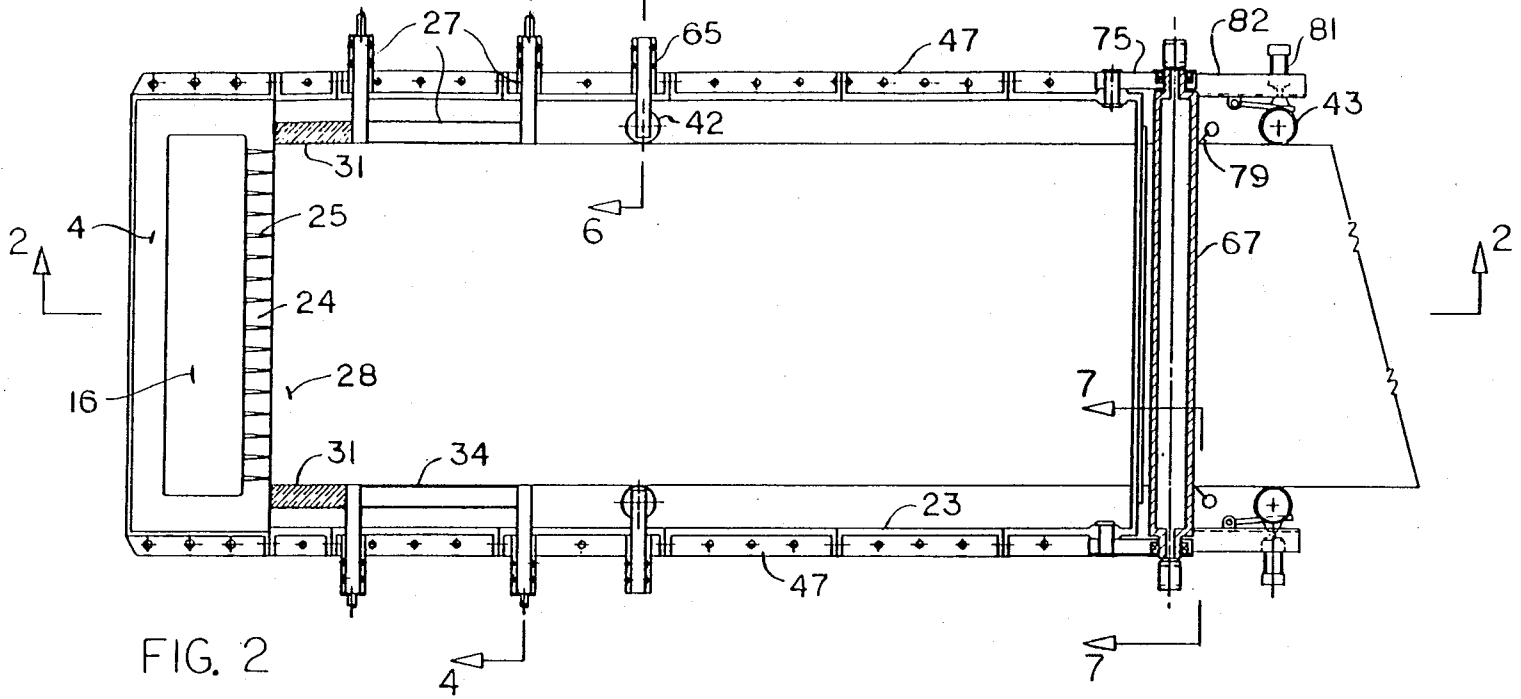
FIG. 3 is a plan view in section along plane 3—3 of FIG. 2.
Figure 2:
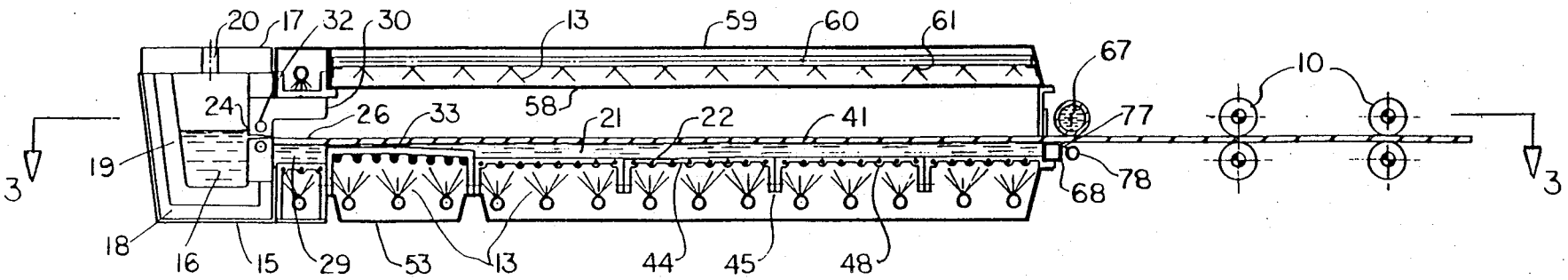
FIG. 2 is a diagrammatic elevation view along plane 2—2 of FIG. 3, in section illustrating the method and apparatus of this invention.
Figure 4:
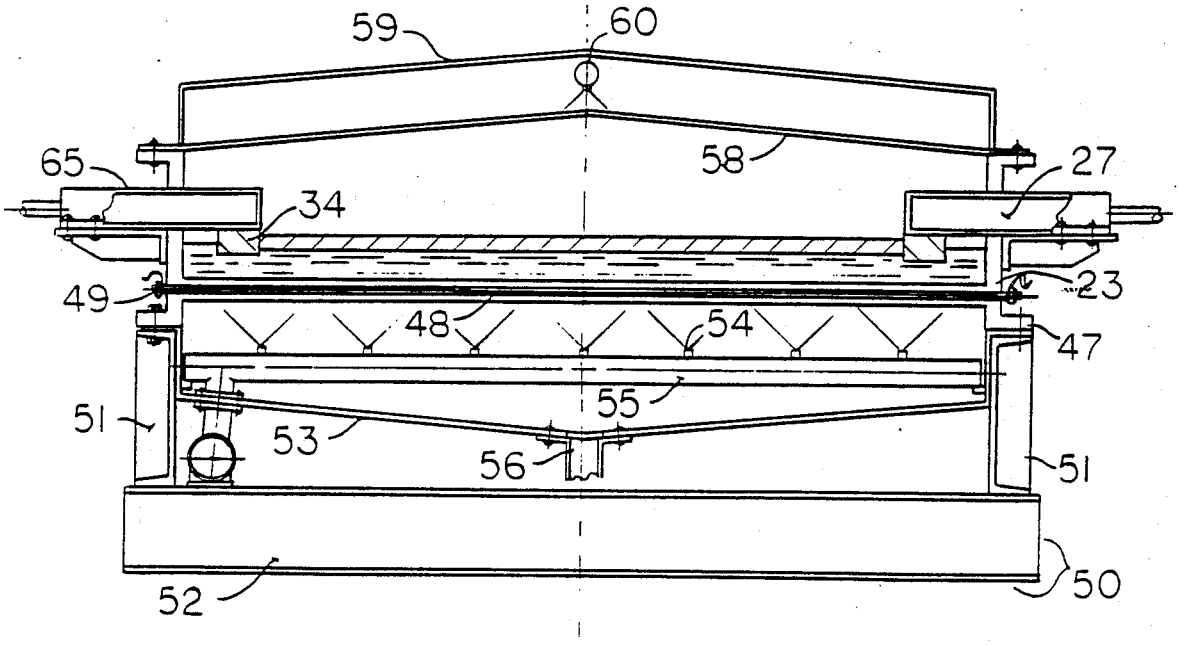
FIG. 4 is an end elevation view in section along plane 4—4 of FIG. 3.

Referring to FIGS. 2, 3 and 4, the launder 4 includes a cover 17 and consists of a ribbed steel shell 15 and is lined with insulating backup refractory 18 and working lining 19 similar to known tundish practice. The molten lead pool 21 is contained within a sectional lead holding tray 22 connected at the entry end to launder 4 and confining the molten lead pool 21 between tray sidewalls 23. The reservoir 16 is separated from the pool 21 by width distributor entry baffle 24 incorporating a plurality of width distributor orifices 25 through which the steel flows by gravity into the floating liquid steel layer 26 spanning across the entry end of pool 21 and confined between casting edge dam assemblies 27. The aggregate open area of orifices 25 is selected to limit flow only to the extent of providing a small immersion head of metal at orifice entry and correspondingly low flow velocity for minimal disturbance upon entry into the floating liquid steel layer 26.

In order to assist in securing a quiescent solidification front of the liquid steel, the preferred embodiment provides an entry-end settling area 28 following entry, wherein the heat extraction rate is moderated by deeper lead pool area 29, a separately-cooled cover area 30 which may include refractory lining; and uncooled edge barrier sections 31, generally of low-conductivity refractory material. This area can also include supplementary heating of the refractory structure and/or edge barrier sections, such as by silicon-carbide heating rods 32 inserted through the baffle area refractory.

The liquid-solid solidification front area, or 'mold-section' provides a lesser depth lead pool area 33 for rapid cooling of the steel bottom face, and mold-section edge dams 34 including provision for more rapid cooling, such as by high-conductivity metal, e g. copper, and may include provision for forced cooling at high casting rates. Feed tubes for mold powder or fluid lubricant such as rapeseed oil, as used in conventional casters, may also be included, directed to lubricate the edge dam faces in this area A mold-section slab-to-tray molten lead depth of about 10–15 mm. achieves a heat flux with order-of-magnitude similar to the usual water-cooled copper mold in a conventional caster Copper can also be used as tray material in this section to maximize heat flux for cooling, whereas steel and ductile iron are perhaps equally suitable for the balance of the tray. The cooling water for this section is also preferably piped and valved separately, adapted for independent modulation of the rate of cooling. Formation of a cohesive and continuous outside shell across the width of the steel slab allows subsequent deepening of the molten lead pool as the slab moves towards the exit end of the pool.

Figure 5:
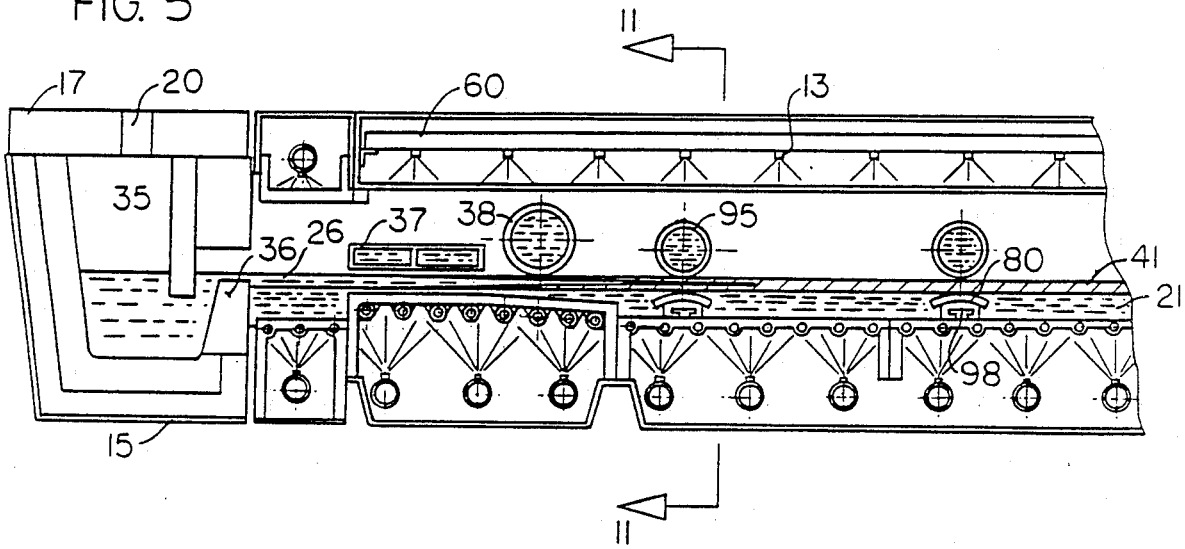
FIG. 5 is a partial view showing the infeed and tray area of FIG. 1, illustrating an alternative infeed arrangement and auxiliary apparatus features.

FIG. 5 illustrates an alternative method of distributing the liquid steel during entry. Rather than a single perforated baffle, the liquid steel flows under an inverted weir 35 within the feed reservoir, then over dam 36 with crest at approximately the steel surface level Preferably, there are notches distributed across the crest of dam 36 between the two edge-dam assemblies 27 to evenly distribute the flow by similar principles to those governing orifices 25. Although it will be appreciated that the notches are not essential, in their absence, a small difference in dam crest elevation causes a significant change in relative rate of flow over the dam. Although only two arrangements have been illustrated, it will be obvious that a large number of practical combinations, configurations, shapes and sizes of baffles, dams, orifices, and notches are possible which would fulfill the criteria of separating the molten lead in the pool from the steel in the feed reservoir and at the same time provide a controlled low-velocity steel flow distributed across the entry end.

FIG. 5 also illustrates a water-cooled top chill-plate 37 for this area as another optional expedient to realize faster freezing and sharper demarcation of the solidification front, and thereby an increased production rate. This may comprise a water-cooled copper plate enclosure, spanning between the edge dams, resting on their top surfaces.

Such a chill-plate may be used alone, or a top slab surface chill roller 38, or rollers, may also be mounted at a level to contact or even slightly depress the solidifying steel to assist in forming a continuous solid top skin across the slab in the liquid-solid solidification front area. Owing to the fragility of the initial skin formed, this roller may be driven at a surface speed paralleling that of the withdrawal pinch rolls. In order to maximize the cooling and skin freezing rate, the roller(s) 38 may be built up as a composite, incorporating a thin outer skin, for example, of copper sheet, beneath which are channels of rapidly circulating water, all mounted on a solid core for reasons of strength and stiffness. This roll technology is well known in the art of cooling apron rolls of conventional slab continuous casting.

A water-cooled flat-chill bar oscillated to a preset cycle is another alternative chill device to roller 38. For example, such a bar could be mounted, and actuated according to various arrangements known in walking-beam devices, to a preset cycle of: (a) lower to make contact; (b) forward stroke; (c) raise; and (d) back stroke return; respectively, with movement (b) synchronized with withdrawal speed, and strokes (a), (c) and (d) relatively fast.

The cooling rate differential between top and bottom slab surfaces increases with increasing casting speed and decreasing lead-pool depth. As also illustrated by FIG. 11, slab warpage caused by differential shrinkage between slab top and bottom may be limited by passing the steel between water-cooled top slab surface guide roller 95 and bottom slab surface guide skids 80. Guide roller 95 is water-cooled with water supplied by way of rotary joints 97 and mounted on adjustably-positioned bearings 96 for setting clearances with the top slab surface. Composite rolls may also be employed in this application to maximize cooling heat transfer rate.

In the embodiment illustrated, the guide skids 80 are mounted on skid-to-tray T-slot attachments 97 requiring a skid-size or pool-depth change for a clearance change. Alternatively, skids can be incorporated into a transverse skid-bar supported from the tray sides, and externally adjustable, which can require a transverse recess in the tray bottom beneath the skid. Bottom skids are better than rollers, considering lubricating properties of molten lead and potential seizing of rolls by freezing of lead against their underside..

Forward slab movement, through a surface drag-effect, also causes some forward movement of the molten lead, at high speeds tending to deplete the lead in the feed-settling area. Referring to FIG. 4, it will be seen that during operation, the sides of the lead pool beyond the slab edges will tend to freeze solid, effectively preventing return of lead to the infeed area, except by counterflow beneath the slab. The arrangement illustrated in FIG. 11 counteracts any difficulty for this reason as casting speeds are increased, by maintaining a molten side-channel lead return, by means of heat from auxiliary tray side-heating elements 98.

During casting, the solidifying hot steel slab 38 is continually being withdrawn by means of withdrawal pinch rolls 10, maintaining a continuous solidification front between totally liquid steel 26 and partially solidified steel slab 41, extending across the slab width between the edge dams 34, following which there is progressive solidification by freezing of the steel slab as it progresses through the partially-solid slab cooling and solidification area, towards the exit end of molten lead pool 21. Lateral side guiding is provided by adjustably, positioned internal edge-alignment rollers 42 and external edge-alignment rollers 43. After exit from the pinch rolls 10, the slab can be cut to length by torch or shear, or alternatively passed on directly to rolling mill stands and coilers, by way of example. It is to be understood that the hot 'solidified' slab under certain circumstances. e.g. high casting rates may still contain some residual liquid or semi-liquid steel in the central area of the cross section, even following the pool exit end, and even up to passing through withdrawal and reduction rolls.

The lead-holding tray 22 comprises U-shaped cast steel sections incorporating bottom plate 44 spanning between sidewalls 23. The transverse end flanges 45 are bolted together and also act as stiffening ribs. Longitudinal top flanges 46 and bottom flanges 47 provide stiffness as well as sealed connections with top and bottom cover enclosures. Each section includes a plurality of transverse heating element channels 48 into which are fitted electric-resistance tubular heating elements 49 heating and maintaining a molten lead pool, prior to the onset of casting.

The sectional lead-holding tray 22 is mounted on a rigid caster support-frame 50 made up of side channels 51 and appropriate cross-beam members 52. The tray cooling spray enclosure 53 is bolted to the longitudinal side flange of the tray bottom and incorporates tray cooling water spray nozzles 54 mounted on spray header pipes 55 and directing cooling water against the tray bottom plate 44. Spent spray water is drained away via collection pans and discharge ducts 56. The tray top cover enclosure 57 is bolted to the longitudinal top flanges 46, and incorporates a water-cooled tray radiation-lid 58 and spray-water containment cover 59, between which are mounted cooling water header pipes 60 and spray nozzles 61 directed against the top of the lid 58 to effect removal of radiated heat from the top of the steel. In order to prevent lead or steel oxidation, dross formation or other undesirable reactions, the enclosure over the pool is continually purged with an inert or non-oxidizing gas such as argon or nitrogen maintaining a very slight positive pressure with the enclosure to prevent ingress of air through any gaps in the sealed openings.

Figure 6:
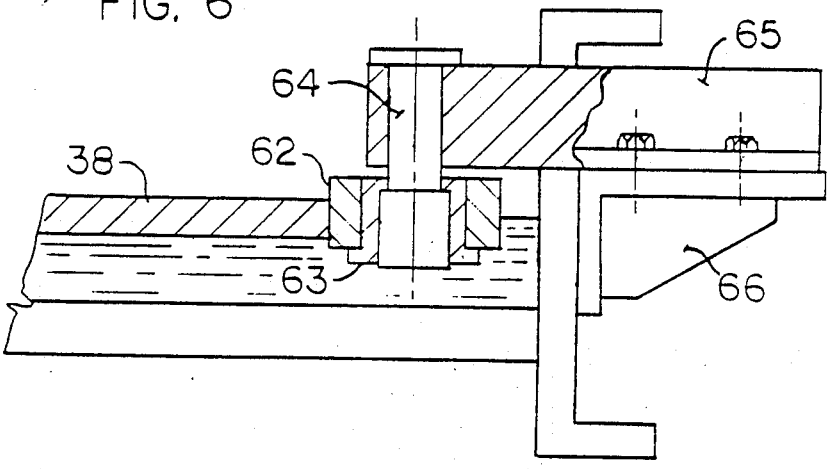
FIG. 6 is a partial elevation view, along plane 6—6 of FIG. 3, of an adjustable internal edge-guide roller assembly.

Referring to FIG. 6, the edges of the floating hot steel slab are typically guided by heat-resistant chrome-nickel alloy edge-guide rollers 62 rotating on bushings 63 mounted on vertical shaft 64, which is carried on support arm 65 projecting through the tray side walls and slidably fastened to fixed mounting bracket 66.

During withdrawal, the hot steel slab is held down by exit hold-down roller 67 to assure sliding in close contact across the top of water-cooled slab bottom-support seal-bar 68, the surface of which is maintained chilled by internal cooling jacket 69. Referring to FIG. 7, the necks of hold-down roller 67 are supplied with cooling water via rotary joint 70 and rotate within bearings 71 attached to pivot frame 75 hinged from the lead holding tray sidewalls. Controlled roll pressure, adjustable at either side of the caster, is applied by pressure cylinders 73.

Referring to FIGS. 8 and 9, the slab edges are similarly sealed by edge seal-bar 74 internally cooled by cooling-jacket 75 and including provision for alignment and adjustment of slab-edge clearance by mounting bracket 76. High-velocity gas curtain seal jets 77 directed from seal header-pipe 78 and supplementary edge-seal nozzles 79 act as an additional barrier blocking exit of molten lead through the slab exit opening. Edge alignment following discharge is provided by the external alignment rollers 43, which are water-cooled and carried on water-cooled support shafts and positioned using positioning cylinder 81 carried on a suitable frame 82.

Figure 10:
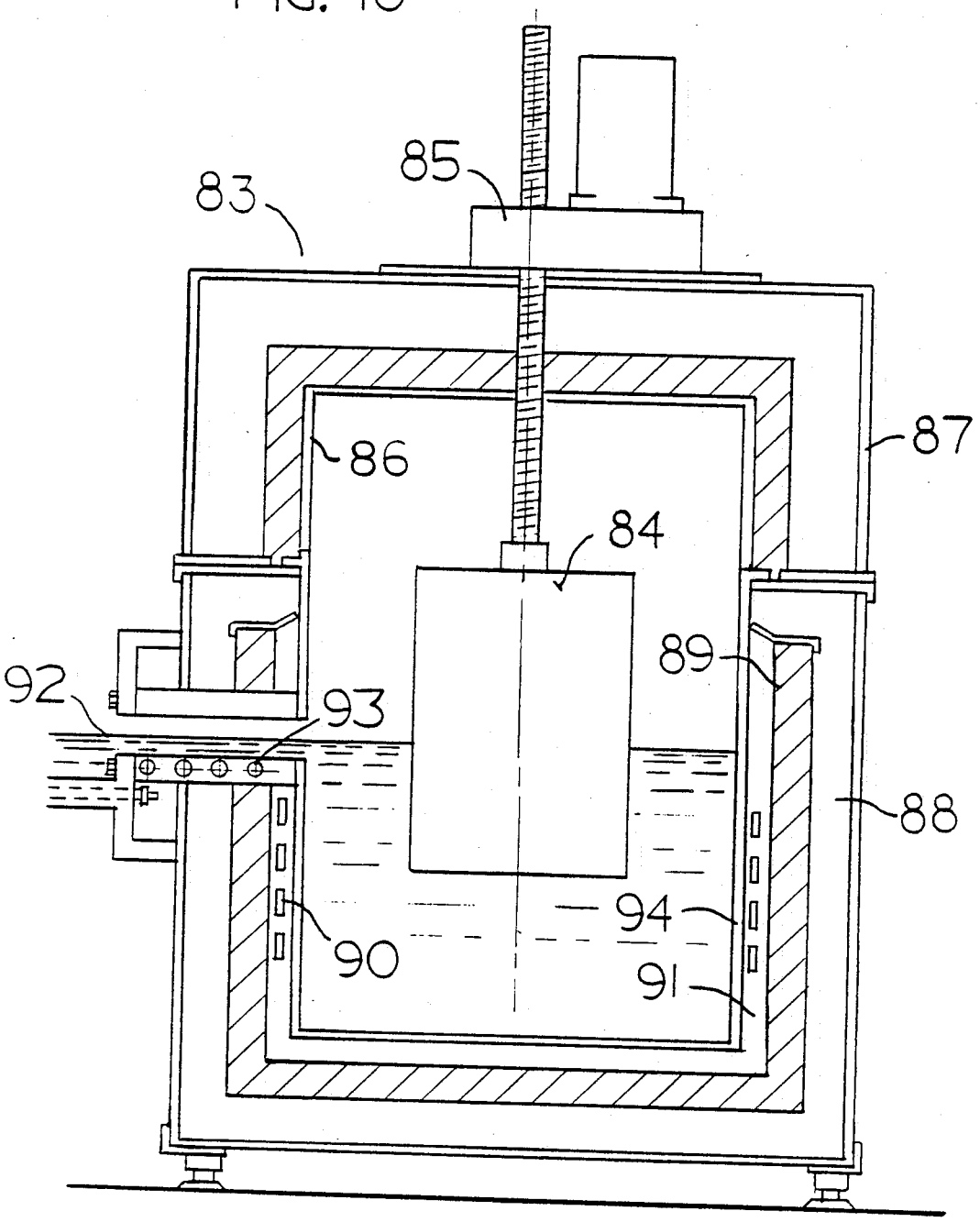
FIG. 10 is an end elevation, in section, of a molten lead melter-reservoir supply.

The lead melting-holding reservoir 83, as shown in FIG. 10, maintains a reservoir of molten lead and provides a convenient method of filling and emptying the molten lead pool 21 from the tray 22. It also provides for molten lead level control, by raising and lowering of the displacement plug 84 by means of ball-screw actuator 85, according to level measurements of a non-contacting metal level gauge. The reservoir 83 is generally similar to known lead and zinc pot furnace construction, comprising an inner container 86, mounted within an outer enclosure 87 lined with an outer layer of insulation 88 and an inner one of impervious refractory 89. Heating, such as by electric resistance heating elements 90 is provided in the space 91, between pot 94 and the refractory 89. Molten lead is transferred to and from the casting tray via transfer flume 92 which also includes tubular heating elements 93. The unit preferably is elongated to provide space for a removable lid and molten metal pump. In another embodiment, the reservoir could be heated by gas or oil burners, as could the lead-holding tray in preparation for casting Electric resistance heating is illustrated because of its convenience, simplicity and ease of control in this application.

In operation, the launder and entry baffle assemblies are prepared and preheated, and a flat plate dummy bar guided horizontally into the 'mold section' and aligned with guide rollers, edge dams and edge seals set to the width desired. The lead is melted and the tray 22 filled to the level desired, as measured by a non-contacting liquid metal level detector. The temperature is adjusted by controlled use of heating elements 32, 49, 90, 93 according to temperature sensor readings taken at various points in the system. A tundish (or ladle) is positioned to feed into launder 4, and a controlled flow commenced at a rate balanced with the selected slab thickness and withdrawal rate. As soon as the liquid steel surface nears the top of the dummy bar head, withdrawal is commenced by withdrawal pinch rolls 10 coincident with switching over to the water-cooling mode of trays and edge dams and guides, sequentially in sections preceding movement of the dummy bar head. Upon exit from the pinch rolls, the dummy bar head is separated and the dummy bar moved aside as with regular slab casters. Heating element, cooling water, guide and seal settings are then adjusted until substantially steady-state continuous casting operation is achieved. The slabs can then be cut-to-length in the regular way, or the caster may be followed immediately by low-speed rolling mill stands in-line, followed by cutting to length, or by direct coiling of hot bands in a continuous rolling mode without intermediate cooling and reheating.

At termination of casting, the steel infeed is shut off. In order to avoid lead spillage through the exit end seal, the lead pool level is lowered just prior to exit of the slab tail end, for example, by raising of displacement plug 84. The launder may also incorporate a suitable emptying plug to avoid formation of a large post-cast skull.

In another embodiment (not illustrated), withdrawal rollers may be located in a lead pool of greatly increased depth preceding the point of exit from the enclosure, incorporating a submerged bending roller for lifting the steel clear of the lead prior to exit from the pond enclosure. This expedient utilizes techniques similar to the art of zinc galvanizing and simplifies exit sealing of the tray, but the operations involved in bending and guiding the steel are mechanically more difficult to operate than the embodiment described in more detail herein.

It will be appreciated that the preferred embodiments of the method and apparatus for continuous lead-float casting of steel have been described and illustrated and that variations and modifications may be made by persons skilled in the art, without departing from the scope of the invention defined in the appended claims.

I claim:

1. A method for the continuous casting of steel comprising:

maintaining a molten lead pool in a lead-holding tray having an entry end, an exit end and an enclosed cover;

maintaining a feed reservoir of liquid steel adjacent said entry end, separated from said molten lead pool by a barrier dam spaced transversely across said entry end separating said pool from said reservoir; allowing continual flow of liquid steel by gravity from said feed reservoir and uniformly distributed between said edge dams by way of at least one passage across said barrier dam to form a top layer of liquid steel floating on the surface of said molten lead pool;

confining either side of said layer of liquid steel between lateral edge dams immersed in said pool and intersecting with said barrier dam, adapted to limit the width of said layer of steel;

continually removing heat from said pool and layer of steel by means of cooling media directly applied to the bottom of said tray; maintaining a solidification front of cohesive solidified steel at a transition between all liquid steel and partially solidified steel slab spanning the width of said pool between said lateral edge dams, by increasing the heat flux from the steel through the lead pool to the tray and cooling media by means of a substantial decrease of molten lead pool depth; continually removing heat from the top of said layer of steel by means of cooling media directly applied to said enclosed cover which, combined with said cooling of said tray, thereby forms a solidified steel slab by progressive freezing of said layer of steel as it passes from said entry end towards said exit end;

continually replenishing said feed reservoir with infeed of new liquid steel; and continually withdrawing said slab away from the exit end of said molten lead pool to make space for additional liquid steel at said entry end thereby maintaining a continuous layer of progressively solidifying steel moving from said entry towards said exit end of said molten lead pool during the course of casting.

2. A method according to claim 1 wherein said passage across said barrier dam comprises a plurality of orifice openings proximate the surface level of said layer of liquid steel, and distributed substantially uniformly between said lateral edge dams.

3. A method according to claim 1 including the step of dividing said feed reservoir into infeed and outfeed compartments by means of an inverted weir projecting downwardly into the steel and the width of said reservoir;

effecting transfer from said outfeed compartment onto said top layer of liquid steel at the entry end by way of continual gravity flow over the crest of said barrier dam separating said molten lead pool from said reservoir outfeed compartment.

4. A method according to claim 1 including the step of maintaining lateral alignment of said slab between said edge dams by the guiding action of adjustably positioned edge guide rollers at either side of the slab immersed in said molten lead pool limiting misalignment by contacting the slab edges, and further maintaining lateral alignment by guiding the slab with additional edge guide rollers following exit from said exit end.

5. A method according to claim 1 including the step of continually withdrawing said slab horizontally from said exit end and also including the step of sealing between the immersed perimeter of said solidified slab and the molten lead pool at exit by interaction with a sealing gate encircling the bottom and both edges of said slab; continually cooling said sealing gate adapted to create a layer of frozen lead on the surface of said sealing gate within any clearances between said slab and said gate thereby at least partially obstructing leakage of molten lead between said slab and said gate upon slab exit from said molten lead pool; and the additional step of directing a high-velocity gas-jet curtain against the external junction between said slab and sealing-gate.

6. A method according to claim 1 including the step of applying forced external cooling media to impinge directly against to the bottom of said lead-holding tray during casting adapted to maintain continual transfer of heat away from the bottom surface and edges of said steel slab during solidification.

7. A method according to claim 1 wherein said forced cooling media is applied in the form of water sprays impinging directly against the bottom of said tray.

8. A method according to claim 1 including the steps of maintaining a substantially sealed top cover over the top of said tray; applying external cooling media directly to the top of said cover to maintain continual heat transfer by radiation away from the top surface of said steel slab to the bottom surface of said cover during solidification; and introducing a non-reactive gas shrouding said molten lead pool and liquid steel within the enclosed cover to limit chemical reactions between said lead and steel and the gases in contact with their surfaces.

9. A method according to claim 1 including the additional steps of: feeding the hot solidified slab from said withdrawing directly into a hot rolling mill and reducing the slab thickness thereby continuously producing a flat hot-rolled product directly, in combination with said method for the continuous casting of steel.

10. A method according to claim 1 including the additional step of localized heating of the tray edge area to maintain lead confined along the pool sides external to the slab edges in a molten state during casting.

11. A method according to claim 1 including the step of maintaining flatness of said slab by positioning it between guides having clearances with top and bottom slab surfaces limiting the vertical movement of said steel slab during casting and passage to withdrawal.

12. An apparatus for continuous casting of steel comprising:

lead-holding tray means having an entry end and an exit end adapted for holding a molten lead pool and allowing a layer of steel to float on the surface of the lead;

edge dam means immersed longitudinally in said pool at least to the maximum depth of said steel adapted to limit the width of said layer of steel;

a width distributor launder at said entry end adapted for maintaining a continually replenished reservoir of liquid steel ready for casting; dividing dam means separating said reservoir and said molten lead pool extending transversely across the pool to connect with the entry end of said edge dam means, and adapted for feeding of liquid steel directly into said layer without direct impingement of liquid steel upon said molten lead pool during said feeding;

cover means enclosing the top of said lead-holding tray; heat removal means by direct cooling applied to the bottom surface of said tray means and top surface of said cover means, adapted for extracting heat from said pool and layer of steel and effecting solidification of said steel intermediate said entry and exit end to form a steel slab having at least its entire surface perimeter solidified; slab withdrawal means adapted for continually withdrawing said steel slab from said exit end;

said lead-holding tray comprises three principal areas:

(1) a feed settling area at the entry end subjected to moderate and restrained heat removal adapted to provide a non-turbulent layer of floating liquid steel across the casting width;

(2) an intermediate liquid-solid solidification front area subjected to intense cooling adapted for rapidly effecting a solidification front of cohesive solidified steel shell spanning between said edge dams, with sharply reduced lead pool depth;

(3) a partially-solid slab cooling and solidification area subjected to moderate cooling adapted to substantially complete the interior solidification of the steel slab with moderate pool depth.

13. An apparatus according to claim 12 wherein said dividing dam means is essentially horizontal and level, extending transversely between said edge dams, with the steel passing from the feed reservoir within said reservoir into said layer of steel in said tray means by flowing over said crest.

14. An apparatus according to claim 12 wherein said dividing dam means incorporates a plurality of orifice holes through said dam, distributed transversely and uniformly to span the dam width extending between said edge dams proximate the surface level of the steel and through which the steel feeds from the feed reservoir within said launder into said layer of steel in said tray means.

15. An apparatus according to claim 12 which also includes an inverted, submerged weir means transverse to the entry end of said pool immersed in said reservoir forming a partial barrier moderating turbulence between steel entry and steel exit from said reservoir.

16. An apparatus according to claim 12 wherein said withdrawal means incorporates lateral guide means including at least one pair of laterally adjustable edge rollers immersed in said molten lead pool adapted for lateral guiding of the edges of said slab during passage.

17. An apparatus according to claim 12 wherein said withdrawal and guide means is adapted to maintain said slab substantially horizontal and coplanar with said layer of liquid steel and which includes sealing gate exit means comprising a force-cooled bottom support seal-bar and edge seal-bars encircling the submerged perimeter of the slab bottom and edge surfaces at said exit end.

18. An apparatus according to claim 17 which also includes a high velocity gas-jet curtain directed to impinge against the interface between said slab and said seal-bars at the point of slab exit.

19. An apparatus according to claim 12 wherein said external heat removal means comprises a bottom external enclosure of said tray and a lid covering the top of said tray, said lid also with a top external enclosure and forced water cooling means applied to impinge and contact the bottom of said tray and the top of said lid within said top and bottom external enclosures, and drain means for collection and removal of spent coolant.

20. An apparatus according to claim 12 which also includes tray heating means adapted for externally heating said lead-holding tray for melting and maintaining the temperature of said molten lead pool prior to the onset of casting.

21. An apparatus according to claim 20 which also includes a supplementary, heated lead melting-holding reservoir in closed communication with said lead-holding tray means; metal level measurement means for said molten lead pool; and metal transfer means for effecting molten lead flow back and forth between said tray and said lead reservoir thereby being adapted to maintain a controlled metal level of said molten-lead pool according to the level measurements obtained.

22. An apparatus according to claim 12 wherein said edge dam means also includes lateral dam adjustment means adapted for lateral adjustment of the distance between said edge dam means and thereby for changing the width of steel slab being cast.

23. An apparatus according to claim 12 including at least three separate forced-cooling adjustment means adapted for individual adjustment of the rate of cooling applied separately to each of said three principal areas.

24. An apparatus according to claim 12 also including lead holding tray side-heating means adapted for heating and maintaining a molten lead channel during casting in the area between the slab edges and side boundaries of said pool, and along which said molten lead is free to circulate longitudinally between the partially solidified cooling and solidification area and the feed-settling area.

25. An apparatus according to claim 12 which also includes top and bottom surface guide means adapted to control and limit vertical displacement of the partially solidified slab during casting.

* * * * *